US010233725B2

(12) United States Patent
Provost

(10) Patent No.: US 10,233,725 B2
(45) Date of Patent: Mar. 19, 2019

(54) DOWNHOLE SYSTEM HAVING ISOLATION FLOW VALVE AND METHOD

(71) Applicant: Wilfred Provost, Saint Martinville, LA (US)

(72) Inventor: Wilfred Provost, Saint Martinville, LA (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 268 days.

(21) Appl. No.: 15/061,555

(22) Filed: Mar. 4, 2016

(65) Prior Publication Data

US 2017/0254175 A1 Sep. 7, 2017

(51) Int. Cl.

| | |
|---|---|
| ***E21B 34/14*** | (2006.01) |
| ***E21B 34/06*** | (2006.01) |
| ***E21B 43/04*** | (2006.01) |
| ***E21B 47/18*** | (2012.01) |
| ***E21B 43/14*** | (2006.01) |
| *E21B 34/00* | (2006.01) |

(52) U.S. Cl.

CPC ..... *E21B 34/066* (2013.01); *E21B 34/14* (2013.01); *E21B 43/04* (2013.01); *E21B 43/045* (2013.01); *E21B 43/14* (2013.01); *E21B 47/18* (2013.01); *E21B 2034/007* (2013.01)

(58) Field of Classification Search

CPC ..... E21B 34/14; E21B 43/04; E21B 43/045; E21B 34/06; E21B 34/102; E21B 34/066

See application file for complete search history.

(56) References Cited

U.S. PATENT DOCUMENTS

| | | | |
|---|---|---|---|
| 5,769,162 | A | 6/1998 | Bartlett et al. |
| 6,397,949 | B1 | 6/2002 | Walker et al. |
| 6,644,404 | B2 | 11/2003 | Schultz et al. |
| 6,722,440 | B2 | 4/2004 | Turner et al. |

(Continued)

FOREIGN PATENT DOCUMENTS

| | | | |
|---|---|---|---|
| EP | 0589586 | A2 | 3/1994 |
| WO | 2010147788 | A1 | 12/2010 |

OTHER PUBLICATIONS

"Fluid Loss Control Devices—SAF-1 Valve"; 2010 Baker Hughes Incorporated; bakerhughes.com, 1 page.

(Continued)

*Primary Examiner* — Kipp C Wallace
(74) *Attorney, Agent, or Firm* — Cantor Colburn LLP

(57) ABSTRACT

A downhole system including a valve including a housing having a longitudinal axis, a flowbore within the housing for fluid flow along the longitudinal axis, an annulus within the housing, the annulus concentrically surrounding the flowbore and fluidically separated from the flowbore, a piston arrangement within the housing, the piston arrangement including a piston movable from a first position to a second position, and an electronic trigger system including an electronic trigger, a first fluid chamber, and a second fluid chamber. Activation of the electronic trigger communicates the first fluid chamber with the second fluid chamber to move the piston from the first position corresponding to a closed condition of the valve blocking flow within the annulus to the second position corresponding to an open condition of the valve permitting flow within the annulus past the piston.

23 Claims, 18 Drawing Sheets

(56) References Cited

U.S. PATENT DOCUMENTS

| | | | | |
|---|---|---|---|---|
| 6,983,795 | B2 | 1/2006 | Zuklic et al. | |
| 7,124,824 | B2 | 10/2006 | Turner et al. | |
| 7,152,678 | B2 | 12/2006 | Turner et al. | |
| 7,198,109 | B2 | 4/2007 | Turner et al. | |
| 7,201,232 | B2 | 4/2007 | Turner et al. | |
| 7,337,850 | B2 * | 3/2008 | Contant | E21B 23/04 166/375 |
| RE40,648 | E | 3/2009 | Turner et al. | |
| 7,497,265 | B2 | 3/2009 | Ross et al. | |
| 7,503,390 | B2 | 3/2009 | Gomez | |
| 7,918,276 | B2 | 4/2011 | Guignard et al. | |
| 7,950,454 | B2 | 5/2011 | Patel et al. | |
| 7,987,909 | B2 | 8/2011 | Pineda et al. | |
| 8,225,863 | B2 | 7/2012 | Hammer et al. | |
| 8,833,468 | B2 * | 9/2014 | Swan | E21B 21/103 166/373 |
| 9,051,810 | B1 * | 6/2015 | Cuffe | E21B 34/066 |
| 9,062,530 | B2 | 6/2015 | Patel et al. | |
| 9,085,960 | B2 | 7/2015 | Van Petegem et al. | |
| 9,187,991 | B2 | 11/2015 | Fripp et al. | |
| 2002/0108755 | A1 * | 8/2002 | Zisk, Jr. | E21B 34/066 166/369 |
| 2003/0019634 | A1 * | 1/2003 | Henderson | E21B 34/10 166/373 |
| 2007/0119598 | A1 | 5/2007 | Turner et al. | |
| 2008/0073080 | A1 | 3/2008 | Corbett et al. | |
| 2013/0014953 | A1 | 1/2013 | Van Petegem | |
| 2014/0083683 | A1 * | 3/2014 | Tips | E21B 47/12 166/250.01 |
| 2014/0238666 | A1 * | 8/2014 | Walton | E21B 47/122 166/250.01 |
| 2014/0338922 | A1 * | 11/2014 | Lopez | E21B 43/12 166/373 |
| 2015/0114619 | A1 | 4/2015 | Fenwick | |
| 2015/0122493 | A1 | 5/2015 | Wood et al. | |
| 2015/0176378 | A1 | 6/2015 | Ramey, Jr. et al. | |
| 2015/0218906 | A1 | 8/2015 | Clem et al. | |
| 2015/0267518 | A1 | 9/2015 | Garcia et al. | |

OTHER PUBLICATIONS

"Model CMP Defender Non-Elastomeric Circulating Sliding Sleeve—Sliding Sleeves"; 2010 Baker Hughes Incorporated; bakerhughes.com, 1 page.

International Search Report for International Application No. PCT/US2015/010034; dated Apr. 16, 2015; 5 pages.

Written Opinion of the International Search Report for International Application No. PCT/US2015/010034; dated Apr. 16, 2015; 10 pages.

International Search Report for International Application No. PCT/US2017/016345; dated May 12, 2017; 3 pages.

Written Opinion of the International Search Report for International Application No. PCT/US2017/016345; dated May 12, 2017; 6 pages.

* cited by examiner

DOWNHOLE SYSTEM HAVING ISOLATION FLOW VALVE AND METHOD

BACKGROUND

In the drilling and completion industry, the formation of boreholes for the purpose of production or injection of fluid is common. Hydrocarbons such as oil and gas can be recovered from the subterranean formation using the boreholes.

A typical multizone well, requiring selective production of at least one zone, is generally configured where one or more upper zones have a control valve assembly, such as a mechanical sliding sleeve located internal to the basepipe, whereby the mechanical sliding sleeve controls circulating flow during the gravel packing operation. In addition to limiting production flow due to their placement within the basepipe, there are limitations with respect to opening procedures of such sleeves.

Thus, the art would be receptive to alternative and improved methods and apparatus for zone isolation systems.

BRIEF DESCRIPTION

A downhole system including a valve including a housing having a longitudinal axis, a flowbore within the housing for fluid flow along the longitudinal axis, an annulus within the housing, the annulus concentrically surrounding the flowbore and fluidically separated from the flowbore, a piston arrangement within the housing, the piston arrangement including a piston movable from a first position to a second position, and an electronic trigger system including an electronic trigger, a first fluid chamber, and a second fluid chamber. Activation of the electronic trigger communicates the first fluid chamber with the second fluid chamber to move the piston from the first position corresponding to a closed condition of the valve blocking flow within the annulus to the second position corresponding to an open condition of the valve permitting flow within the annulus past the piston.

A method of permitting flow in an annulus of a valve includes arranging a piston in a first position corresponding to a closed position of the valve to block continued annular flow within the valve; activating an electronic trigger with a communication signal; and moving the piston to a second position corresponding to an open position of the valve to permit continued annular flow within the valve.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1A:
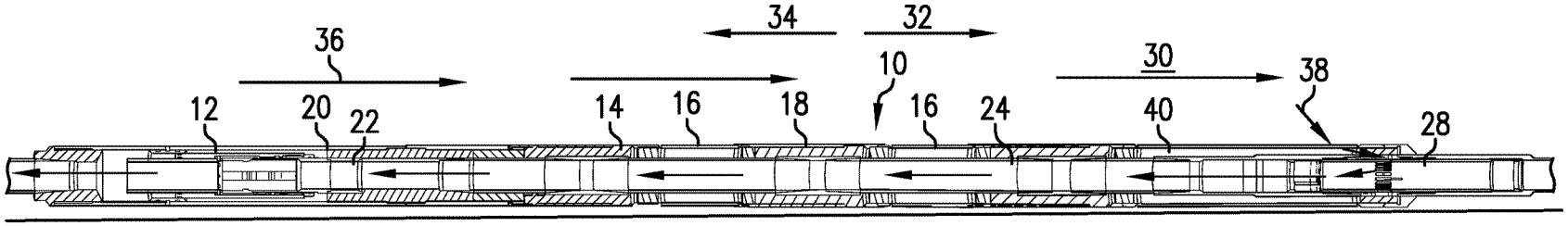
FIGS. 1A-1C schematically depict an embodiment of a gravel packing and production system incorporating an embodiment of a flow valve.
Figure 1B:
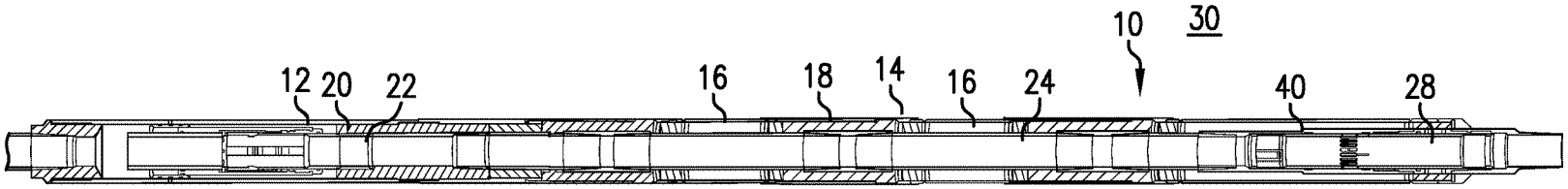
Figure 1C:
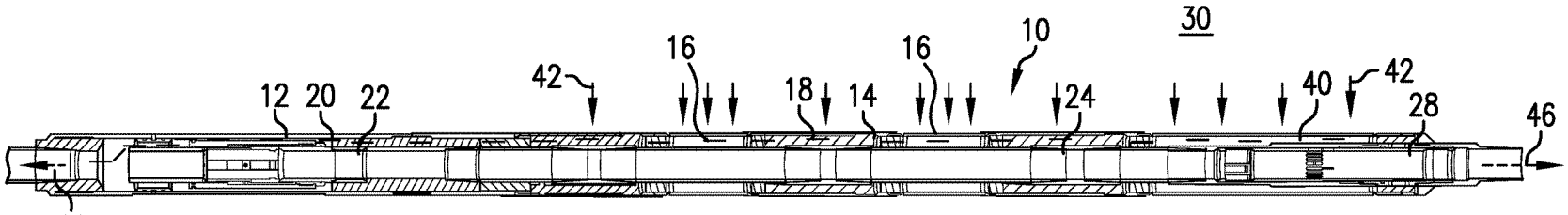

With reference now to FIGS. 1A-1C, one embodiment of a downhole system 10, such as a gravel packing and production system, incorporates an isolation flow valve 12. In addition to the valve 12, the system 10 includes a screen section 14 having any number and arrangement of screens 16 and perforated shrouds 18 (or different types of screens) that are connected to a downhole end of a housing 20 of the valve 12 (there may also or alternatively be additional pipe between the housing 20 and the screen section 14). The valve 12 also includes a tubular mandrel 22, which is connected to tubing 24 within the screen section 14. A screen wrapped sliding sleeve 28 is located downhole of the screen section 14. During a gravel packing operation, as demonstrated in FIG. 1A, gravel slurry 36 is directed in an annulus 30 between the system 10 and a borehole wall 31 (FIGS. 18-19) in a downhole direction 32. Fluid 38 from the slurry 36 enters the tubing 24 through the sliding sleeve 28, and is redirected in an uphole direction 34 towards surface. The fluid 38 passes through the tubing 24, the mandrel 22, and any additional tubing attached to an uphole end of the valve 12. To isolate a zone prior to production, the sliding sleeve 28 may be shifted such that apertures in the sliding sleeve 28 are misaligned with the screen, as shown in FIG. 1B. The valve 12 in FIG. 1B is in a closed condition, and therefore any flow of fluid 38 entering into an annulus 40 between the housing 20/shroud 18 and the mandrel 22/tubing 24 through the screen section 14 is prevented from uphole travel past the valve 12. However, flow from lower zones, as will be further described below, may continue to flow through the main flowbore 44 along longitudinal axis 46. In FIG. 1C the valve 12 is in an open condition such that flow of fluid 38 is allowed there past. Depending on whether the production fluids 42 are to remain in the annulus 40 or commingle with other production fluids 42 from a lower zone, the flow of fluids 42 may continue in the annulus 40, or, as shown in FIG. 1C, the flow of fluids 42 may be redirected to main flowbore 44, which flows along a longitudinal axis 46 of the housing 20 and system 10. That is, selection of flow between the annulus 40 and flowbore 44 can be determined depending on which zone the valve 12 is intended to be utilized and depending on what is to be accomplished. The flow can either continue up the annulus 40 (as demonstrated in FIG. 5, for example), or alternatively the flow can be permitted to commingle with the main flowbore 44 as shown in FIG. 1C. In one example, if the valve 12 were positioned at an upper zone, then the flow would continue on up the annulus 40, and if the valve 12 is positioned in a lower zone, then the flow may enter into the main flowbore 44.

With reference now to FIGS. 2-6, one embodiment of the valve 12 is shown in more detail. The housing 20 surrounds the components of the valve 12, including the mandrel 22. The mandrel 22 includes a first portion 48, a second portion 50, and a slotted portion 52 between the first and second portions 48, 50. The slotted portion 52 includes a number of longitudinally extending slots 54 through which a portion of a number of keys 56 extend. Key profiles 58 on the keys 56 are accessible through the flowbore 44. In one embodiment, a set of separate keys 56 are installed around the perimeter of the slotted portion 52, with the key profiles 58 extending radially inward through the slots 54. Radially exterior to the keys 56 are a set of shear links 60 secured at a first end 62 (FIG. 6), such as by shear pins 66, to the first portion 48 of the mandrel 22. A second end 64 of the shear links 60 includes a projection 65 that protrudes radially inward towards the slotted portion 52 to provide a catch. The shear links 60 and keys 56 provide a mechanical option for opening the valve 12, as will be further described below.

Figure 2:
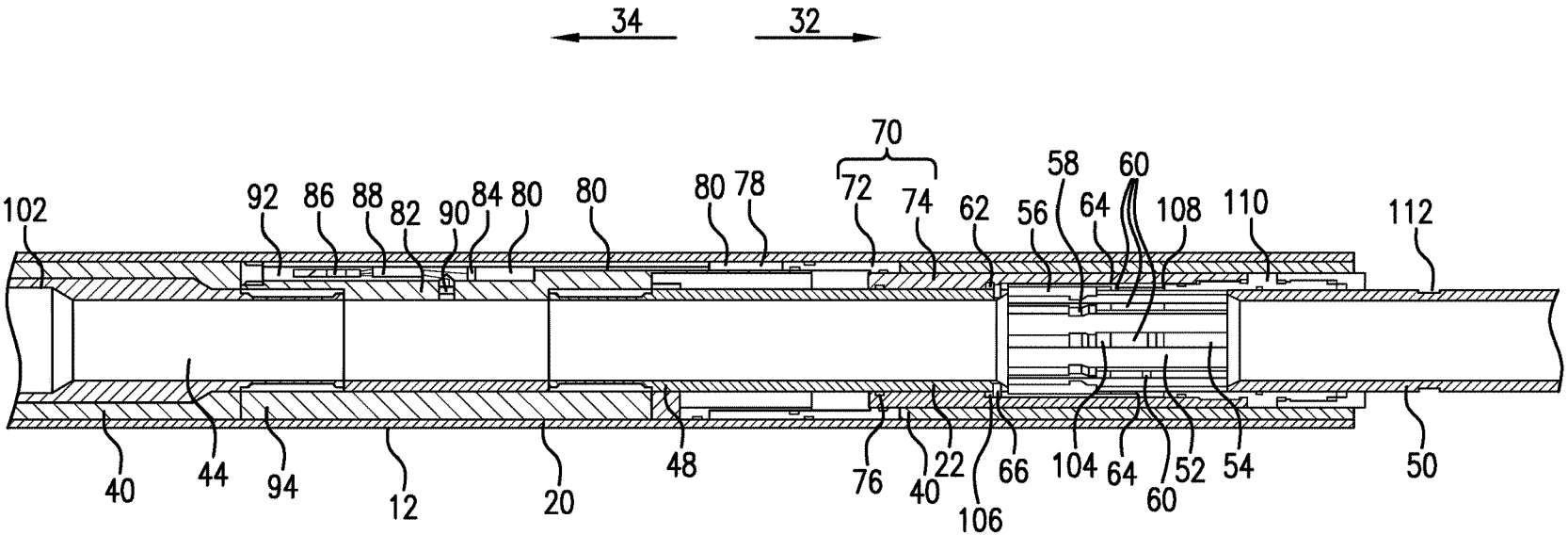
FIG. 2 shows a sectional view of one embodiment of an isolation valve in a closed condition.
Figure 3:
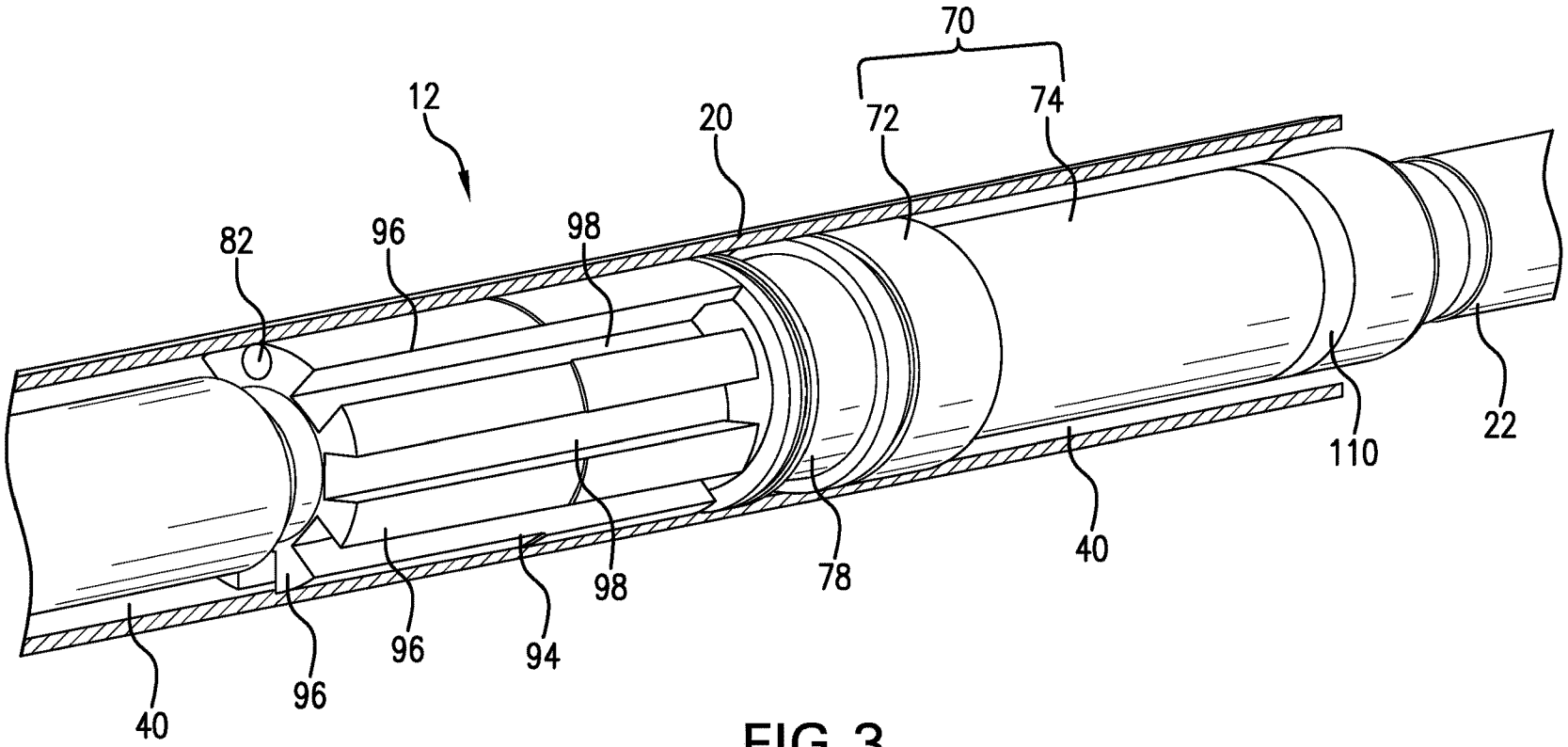
FIG. 3 shows a perspective, partial cut-away view of the valve of FIG. 2 in the closed condition.

Radially exterior and surrounding the shear links 60, slotted portion 52, and the first portion 48 of the mandrel 22 is a piston arrangement 70. In the illustrated embodiment of FIGS. 2-6, the piston arrangement 64 includes an electronically activated first piston 72 and a mechanically activated second piston 74, where the first piston 72 is an outer piston and the second piston 74 is an inner piston, with the first piston 72 at least partially overlapping the second piston 74 in a closed condition of the valve 12 to block movement of the fluid flow in the annulus 40 past the valve 12. In particular, as shown in FIGS. 2 and 3, flow is blocked by a downhole end of the first piston 72, which, due to the overlap with the second piston 74, prohibits fluid 42 from continuing uphole travel within the annulus 40. An o-ring seal 76 may be provided between the overlapping portion between the first and second pistons 72, 74 to ensure no leakage of fluid 42 in the closed condition of the valve 12. The first piston 72 is movable in the uphole direction 34 by an electronic trigger system 82, but prevented from doing so in the closed condition of the valve 12 by a first fluid chamber 78, such as a hydraulic fluid chamber containing hydraulic fluid 80, such as, but not limited to oil, adjacent an uphole end of the first piston 72. The first fluid chamber 78 is in fluidic communication with an electronic trigger 84 of the electronic trigger system 82. In addition to the first chamber 78 and the electronic trigger 84, the electronic trigger system 82 may further include a controller 86 (circuit board/microprocessor), battery 88, a communication signal-receiving member for receiving a communication signal such as, but not limited to, a pressure sensor (pressure transducer) 90 arranged to receive a pressure signal, and second fluid chamber 92, such as an atmospheric air chamber. The second chamber 92 has a lower pressure than the first chamber 78. The electronic trigger 84, or at least a portion of the electronic trigger 84, is positionable between the first and second chambers 78, 92 such that the first and second chambers 78, 92 are not fluidically communicable during the closed condition of the valve 12. The controller 86 and battery 88 may be positioned in the first chamber 92.

In embodiments that include the pressure transducer 90 as the signal-receiving member, the pressure transducer 90 will generate voltage based on sensed pressure, and these voltage signals are sent to the controller 86. The pressure transducer 90 is fluidically communicable with pressure in the main flowbore 44, and reads a pressure signal sent from a surface location from which the downhole system 10 extends. The controller 86 determines if the received signal matches the preset opening signal. If it does, then the controller 86 sends some current to the electronic trigger 84. In some embodiments of the electronic trigger 84, a disc within the electronic triggers 84 melts, dissolves, or is otherwise removed, or a small valve is shifted or moved, so that flow from the chamber 78 can flow into the chamber 92. Pressuring up on the well to the preset pressure signal actuates the valve 12, and the electronic trigger system 82 is programmed to actuate the valve 12 in response to a specific pressure profile. For example, the controller 86 may be programmed to only deliver the voltage to the electronic trigger 84 after a certain pressure is held for a certain time period as determined by the pressure transducer 90, which eliminates the possibility of pressure spikes inadvertently triggering the valve 12, or other operations that may require a same pressure but over different time spans triggering the valve 12. Thus, only a specific pressure profile, such as one pressure over a particular time period, or a sequence of pressures (having the same pressure or a combination of different pressures) over a certain time period, will actuate the valve 12. This is also helpful when several valves 12 are employed in a system 10, as will be further described below with respect to FIGS. 18 and 19. Each valve 12 in the system 10 can be programmed to open at a different pressure profile, thus providing an accurate and simple method of operating different valves 12 downhole. Further, the controller 86 in each electronic trigger system may be programmed to activate the electronic trigger 84 after a set time period, and the time period may be different for each valve 12 in the system 10. For example, one valve 12 may be triggered to open at a substantially same time that a pressure signal is detected, while another valve 12 may be triggered to open after a time delay after the controller 86 determines that the pressure signal is received. The electronic trigger system 82 may also include multiple pressure transducers 90 that detect pressure in different locations within the system 10. While a pressure transducer 90 has been disclosed as one embodiment for detecting pressure signals as the communication signals from surface, in alternate embodiments other types of sensors for detecting other signals may be provided in the electronic trigger system 82. Some alternative embodiments include, but are not limited to, a temperature sensor that detects a temperature signal, an inductive coupling sensor that detects a passing magnet, fiber optics that detect a light signal, and wiring that detects an electrical signal.

The electronic trigger system 82 is at least partially provided within sub 94 of the valve 12. As best seen in FIG. 3, the sub 94 includes a plurality of radially projecting lobes 96 that are alternatingly separated by longitudinally extending channels 98. While a channeled sub 94 is illustrated, alternatively, fluid flow passage may be provided by perforations in the sub 94 that are accessible once the valve 12 is actuated. The lobe 96 that accommodates at least portions of the electronic trigger system 82 may have a larger area with respect to the radial perimeter as compared to the remaining lobes 96 in order to accommodate features of the electronic trigger system 82. In the illustrated embodiment, the air chamber 92, pressure transducer 90, controller 86, battery 88 and electronic trigger 84 are all contained within the lobe 96 of the sub 94.

Figure 4:
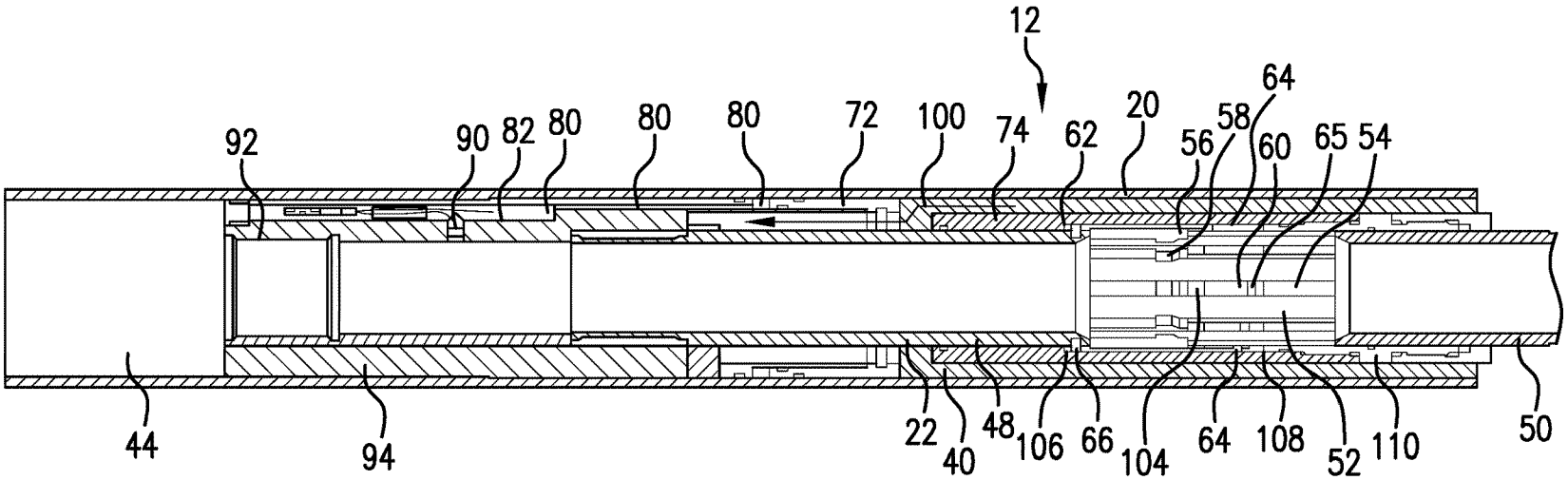
FIG. 4 shows a sectional view of the valve of FIG. 2 in an electronically triggered opened condition, in an embodiment where annular flow is commingled with flow along a longitudinal axis uphole of the valve.

Activation of the electronic trigger 84 will expose the air chamber 92 to the hydraulic fluid 80 in the hydraulic chamber 78. That is, the hydraulic fluid 80 will flood the air chamber 92 and the first piston 72 will be pulled in the uphole direction 34 by the suction force (from the hydraulic fluid 80 moving into the air chamber 92) and fluid flow force (from the flow in the annulus 40). A downhole end of the sub 94 provides a piston stop to limit uphole travel of the first piston 72. During movement of the first piston 72 in direction 34, the downhole end of the first piston 72 will distance itself from the uphole end of the second piston 74 providing a space for the flow 100 from the annulus 40 to travel past the valve 12. In particular, the flow 100 will move past the radial exterior of the second piston 74, past the end of the second piston 74, and then radially interior of the first piston 72. The flow 100 will then move through the longitudinal channels 98 of the sub 94. After the flow 100 moves past the sub 94, it can either continue through the annulus 40 provided uphole of the sub 94 as shown in FIG. 2, or alternatively, the flow can move into the main flow bore 44, as shown in FIG. 1C and FIG. 4. To maintain the flow 100 in the annulus 40, an uphole end of the sub 94 is connected to a tubing 102, an interior of which provides the main flow bore 44. The tubing 102 thus fluidically separates the flowbore 44 from the annulus 40. An interior of the tubing 102 is fluidically communicable with the tubing 24 that is connected to a downhole end of the valve 12.

Figure 5:
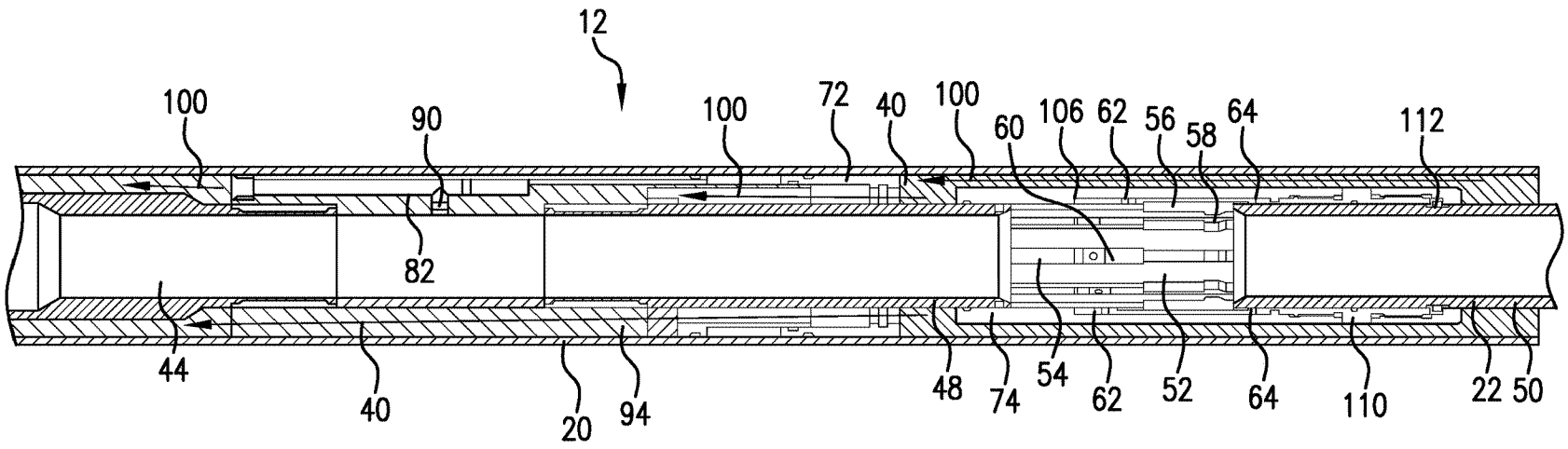
FIG. 5 shows a sectional view of the valve of FIG. 2 in a mechanically opened condition, in an embodiment where annular flow is maintained uphole of the valve.
Figure 6:
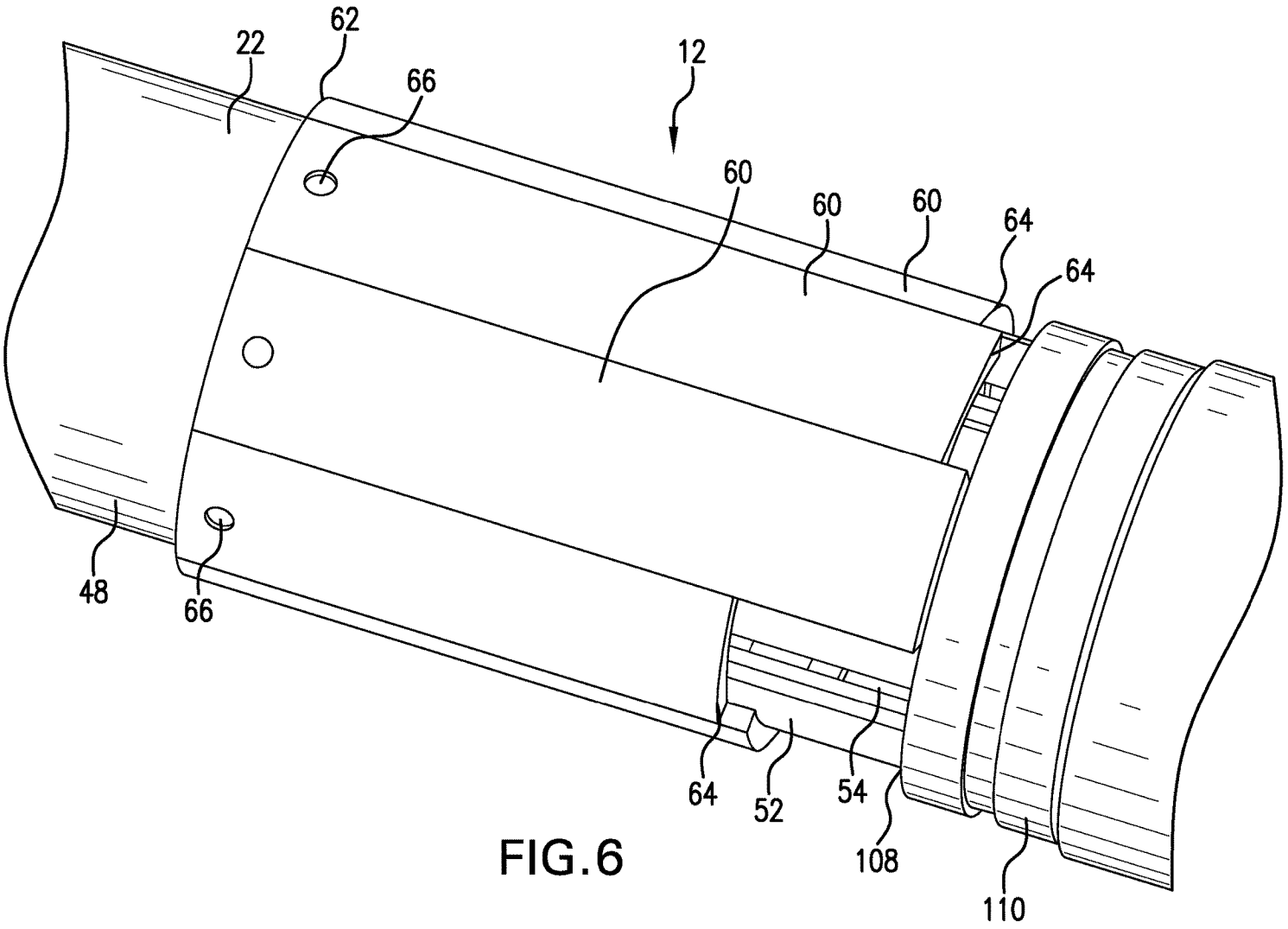
FIG. 6 shows perspective view of portions of the valve of FIG. 2, including an embodiment of a staggered shearing mechanism.

As described above, the valve 12 is openable by activation of electronic trigger 84. If the electronic trigger 84 fails to activate, a mechanical option for opening the valve 12 includes engaging a shifting tool (not shown) inserted within the flowbore 44 with the key profiles 58. The keys 56 are initially positioned at a first (uphole) end of the slots 54 of the slotted portion 52 of the mandrel 22, and the keys 56 are engageable by the shifting tool if a mechanical shifting of the valve 12 is necessary. A key ring 104 (FIGS. 2 and 4) is placed downhole of the keys 56. The projection 65 at the second end 64 of each shear link 60, which projects radially inward towards the slotted portion 52, is engageable by the key ring 104. At least two of the shear links 60 have a different length, such that the projections 65 of the shear links 60 are initially provided at different longitudinal locations with respect to the longitudinal axis 46. The second piston 74 includes an interior shoulder 106 that abuts with the first end 62 of the shear links 60 when in the first position of the second piston 74. If mechanical actuation of the valve 12 is desired, the shifting tool is delivered downhole through the main flowbore 44 and an outer profile of the shifting tool engages with the key profile 58. The keys 56 shift through the slots 54, pushing the key ring 104 non-simultaneously into each of the projections 65 of the shear links 60. That is, due to the varying lengths of the shear links 60, the shear links 60 are not all engaged by the key ring 104 at the same time, thus, the shear pins 66 are not all sheared at the same time. This arrangement thus reduces the force required by a shifting tool to mechanically actuate the valve 12, enabling actuation of the valve 12 via a shifting tool on slickline rather than expensive coiled tubing. Once all of the shear links 60 are engaged by the key ring 104 and the shear pins 66 are sheared, the second ends 64 of the shear links 60 are longitudinally aligned at stop 108, and the valve 12 is mechanically openable as shown in FIG. 5. After the shear links 60 have all been sheared from the mandrel 22, the second piston 74 is movable (with member 110 having the stop 108) to a select location 112 along the second portion 50 of the mandrel 22. The keys 56 are slidable within the slots 54 to the second (downhole) end of the slots 54, adjacent to the second portion 50 of the mandrel 22. Thus, as shown in FIG. 5, even though the first piston 72 is not actuated towards the sub 94 to provide the flow path for the flow 100, during mechanical actuation the uphole end of the second piston 74 is spaced away from the downhole end of the first piston 72, thus allowing annular flow 100 from the annulus 40 towards the sub 94.

Thus, flow 100 coming up the annulus 40 downhole of the valve 12 stops at the piston arrangement 70 when the valve 12 is in a closed condition. Then, when either piston 72 shifts in the uphole direction 34 and/or piston 74 shifts in the downhole direction 32, there is a gap between the pistons 72 and 74 and the flow 100 can come up around the second piston 74 and then radially inward through the first piston 72 and then up through the sub 94 in the channels 98. From there, the system 10 can be configured to either continue to direct the flow through annulus 40 as shown in FIG. 5, or alternatively tubing 102 can be removed such that the flow 100 from the annulus 40 commingles with flow from lower zones in the flowbore 44. For example, if the valve 12 is positioned in an upper zone, then it may be desirable for the flow 100 to continue on up the annulus 40, and if the valve 12 is positioned in a lower zone, then the flow 100 may be directed in the flowbore 44.

With reference now to FIGS. 7-16, another embodiment of the isolation valve 12 is shown, numbered 112. As in the valve 12, the valve 112 operates using an electronic trigger 84 to actuate a piston arrangement 170 to permit annular flow 100 to continue past the valve 112. Also as in the valve 12, the valve 112 can be alternatively opened mechanically. The valve 112 additionally provides the operator with the ability to reclose the valve 112. Thus, the valve 112 can be opened via electronic trigger 84, opened mechanically, and also opened and closed mechanically as many times as desired by the operator. In order to close the valve 112 mechanically, and have it stay closed despite downhole pressures, the valve 112 includes a locking mechanism 200 to maintain the valve 112 in the closed position (after the valve 112 has already been opened once).

The electronic trigger system 182 of the valve 112 may include an electronic trigger module 184 (FIG. 15), such that the components of the electronic trigger system 182 are packaged within the module 184. This allows the electronic trigger module 184 to be easily inserted within the valve 112, such as by screwing or otherwise securing the module 184 into the valve 112. This removes the need for operators on the field to deal directly with the electronics of the electronic trigger system 182. That is, at most, operators on the field will only have to insert the module 184 into the valve 112 for assembly. A housing 186 protects the electronic components of the valve electronic trigger system 182 from the environment during assembly. Although the electronic trigger system 82 of the valve 12 does not include a module, in alternate embodiments the electronic trigger system 82 could be modified to include a housing, such as housing 186, to provide the electronic trigger system 82 in a module instead. Also, the valve 112 could alternatively incorporate the electronic trigger system 182 as shown and described with respect to the valve 12.

Figure 7:
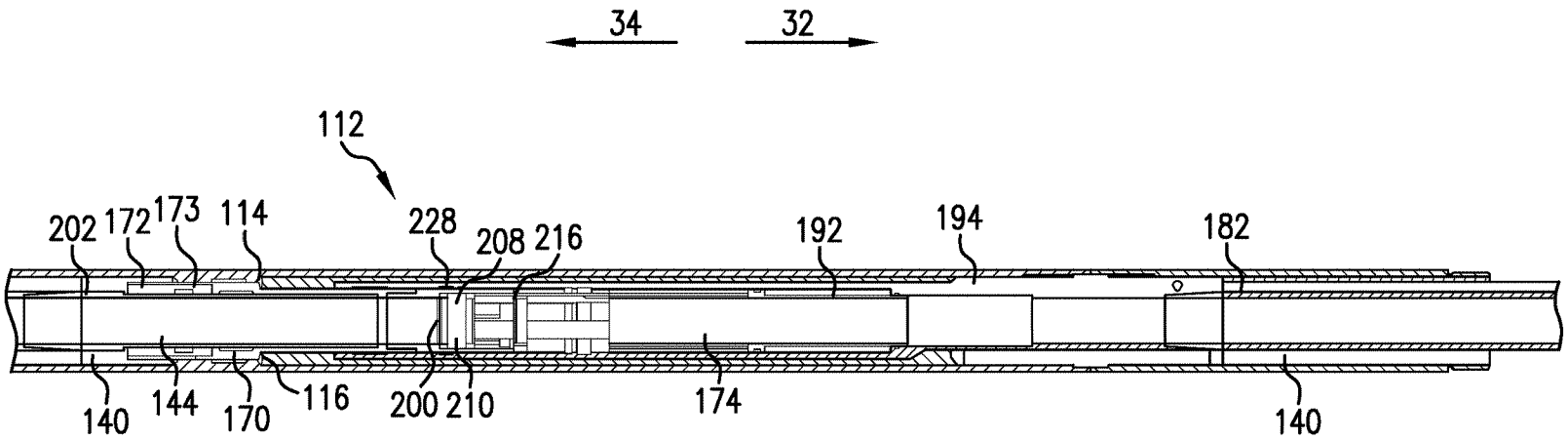
FIG. 7 shows a sectional view of another embodiment of an isolation valve in a closed condition.
Figure 8:
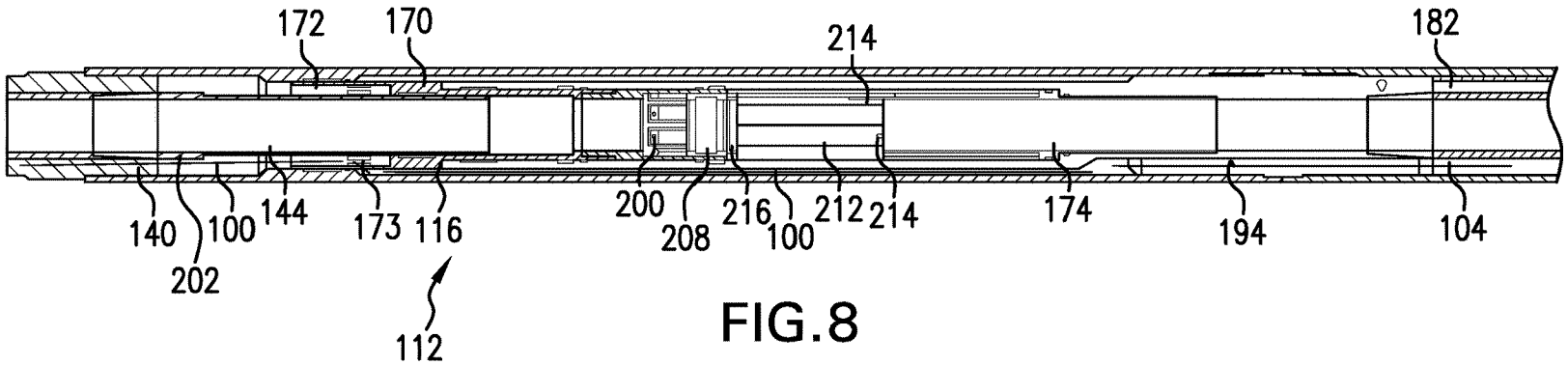
FIG. 8 shows a sectional view of the valve of FIG. 7 in an electronically triggered open condition of the valve, in an embodiment where annular flow is maintained uphole of the valve.
Figure 9:
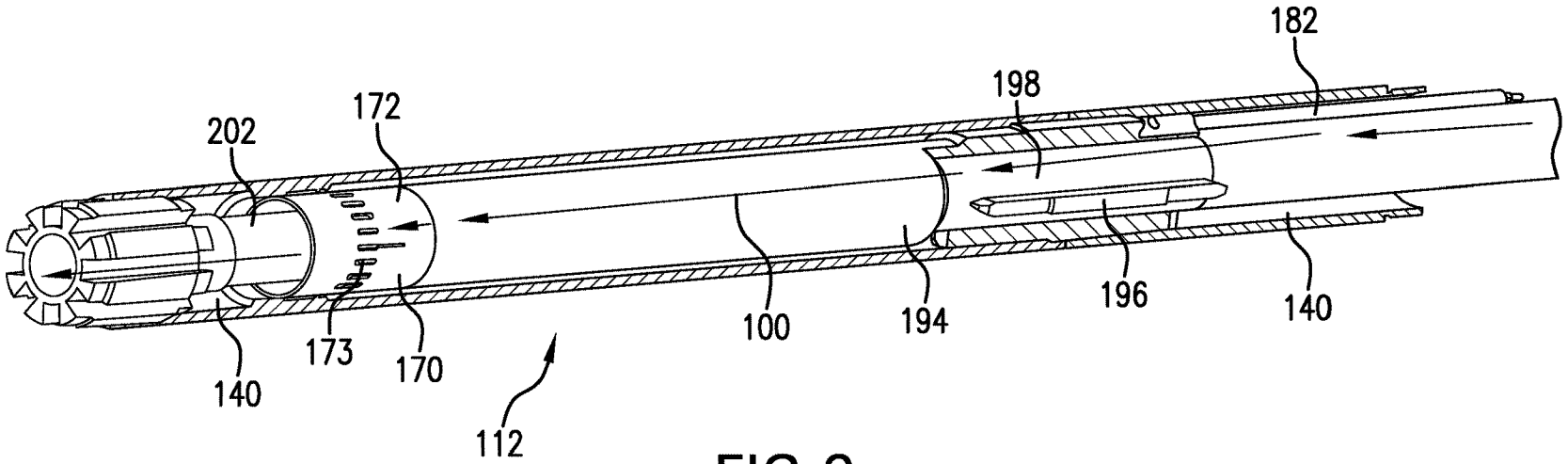
FIG. 9 shows a perspective, partial cutaway view of the valve of FIG. 7 in the open condition, in an embodiment where annular flow is maintained uphole of the valve.
Figure 10:
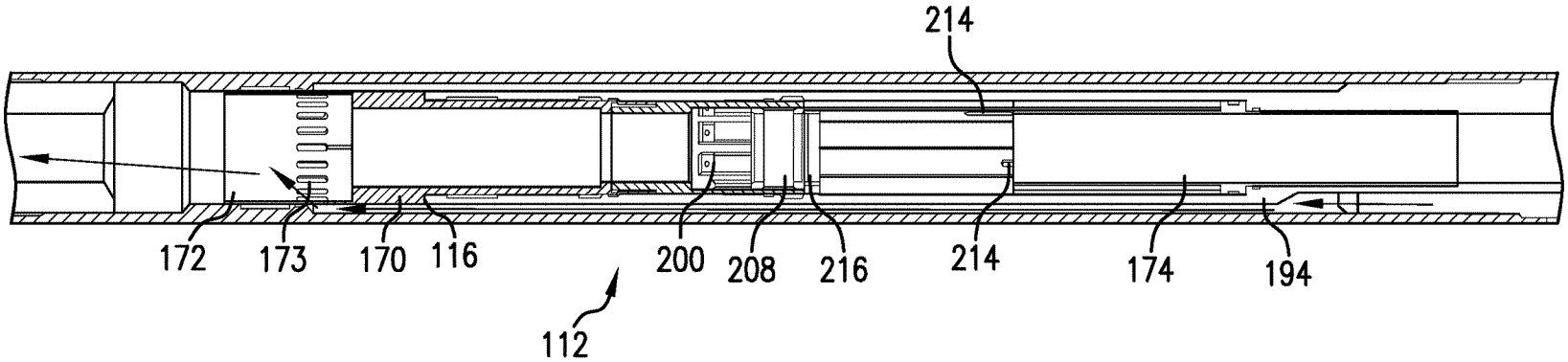
FIG. 10 shows a sectional view of the valve of FIG. 7 in an electronically triggered open condition of the valve, in an embodiment where annular flow is commingled with flow along a longitudinal axis uphole of the valve.

FIG. 7 shows a run-in (closed) condition of the valve 112, while FIG. 8 shows an actuated (electronic triggered, open) condition of the valve 112. The piston arrangement 170 includes a first piston 172 that includes a plurality of radial flow ports 173. The piston 172 is movable from a first position shown in FIG. 7, corresponding to a closed condition of the valve 112, to a second position shown in FIG. 8, corresponding to an open condition of the valve 112. In FIG. 7, continued movement of the flow 100 through the annulus 140 in the uphole direction 34 is prevented at location 114 because annulus 140 is blocked by a restricted diameter of the annulus 140 at location 114 and a blocking shoulder of the first piston 172 seated at location 114. The flow ports 173 of the piston 172 are spaced from the downhole section of the annulus 140 and thus fluid communication through the annulus 140 past the valve 112 is blocked when the first piston 173 is in the first position shown in FIG. 7. In FIG. 8, when the piston 172 is moved in the downhole direction 32, the flow ports 173 are arranged to be longitudinally aligned with the downhole section of the annulus 140 so as to fluidically communicate the downhole section of the annulus 140 with an uphole section of the annulus 140 in order to allow flow 100 to continue past the valve 112. As in the valve 12, the flow 100 may either continue through annulus 140 as shown in FIGS. 8 and 9, due to tubing 202 that fluidically separates the annulus 140 from the flowbore 144, or may alternatively commingle with flow through the main flowbore 144, as depicted in FIG. 10, when the tubing 202 is not included.

Figure 13:
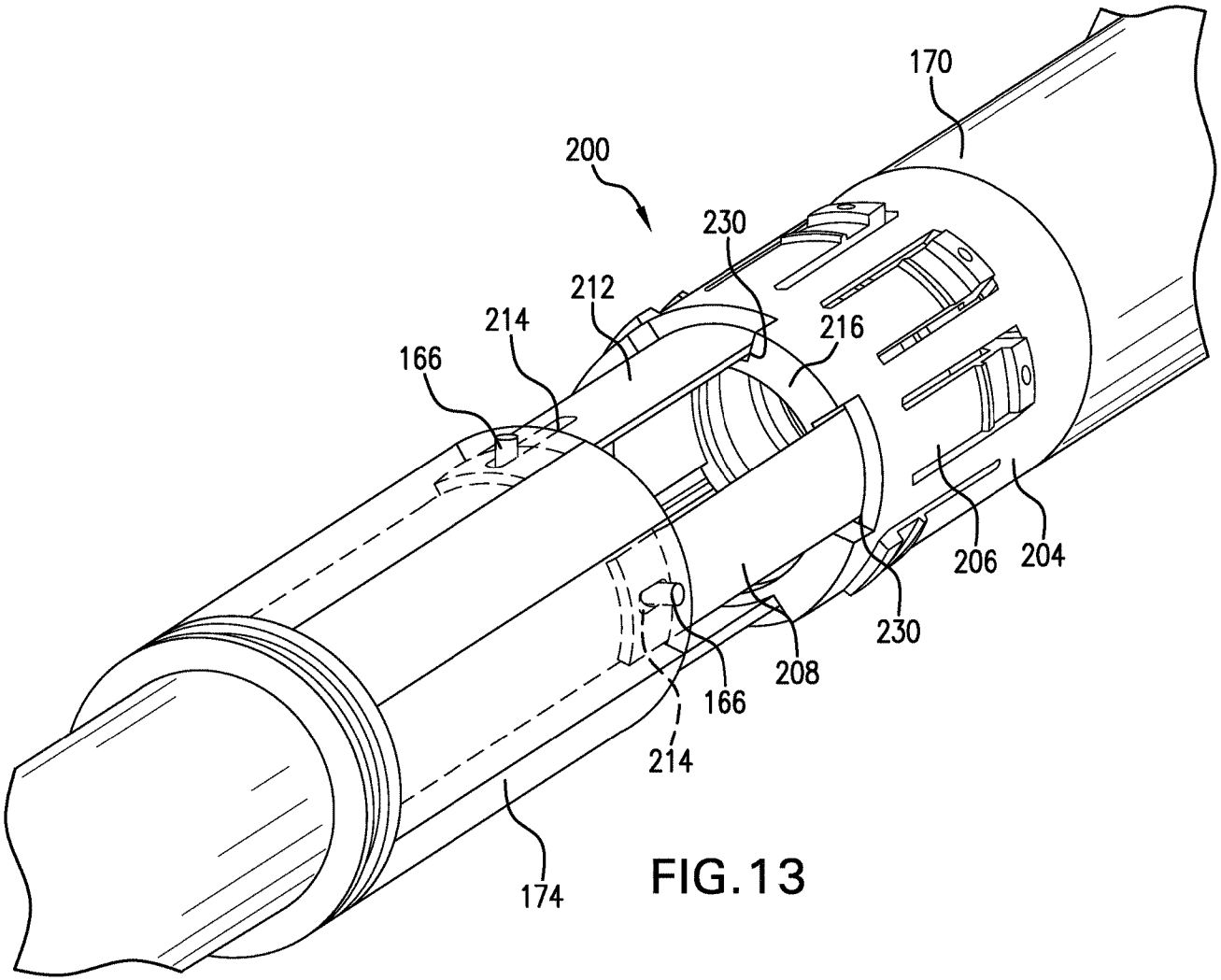
FIG. 13 shows a perspective view of an embodiment of a locking mechanism for the valve of FIG. 7.

A downhole end of the piston 172 is connected to a locking sleeve 204 of the locking mechanism 200. In the illustrated embodiment, the piston 172 is threaded to the locking sleeve 204, however alternate attachments are possible. The locking sleeve 204 includes a plurality of fingers 206 (FIG. 13), and supports a profile sleeve 208 (FIG. 12) thereat. The profile sleeve 208 includes a ring 210 at a first end and a plurality of spaced longitudinally extending fingers 212 extending to a second end of the profile sleeve 208. The ring 210 of the profile sleeve 208 is trapped within the locking sleeve 204, as shown in FIG. 13, but longitudinally movable within the locking sleeve 204. Each finger 212 of the profile sleeve 208 includes a slot 214 adjacent the second end of the profile sleeve 208. Although the fingers 212 may have a same or a substantially same length, at least two of the slots 214 are of different lengths, and in the illustrated embodiment, each slot 214 has a different length.

The fingers 212 of the profile sleeve 208 are secured, such as screwed or shear pinned, to second piston 174 of piston arrangement 170. The second piston 174 is movable upon electronic activation of the electronic trigger system 182. When the valve 112 is electronically activated following the run-in condition shown in FIG. 7, the second piston 174 will be shifted in the downhole direction 32 (see FIG. 8) and pull the fingers 212 of the profile sleeve 208 in the downhole direction 32, such that the profile ring 210 is pulled down towards wall 216 of the locking sleeve 204, which then also shifts the locking sleeve 204 in the downhole direction 32 as well as the connected first piston 172. With the first piston 172 in the position shown in FIG. 8, the flow 100 from the downhole section of the annulus 140 can continue as shown in the uphole direction 34 through the uphole section of the annulus 140, or into the main flowbore 144 as previously described, depending on whether the valve 112 is connected to tubing 202. In order to move the second piston 174 in the downhole direction 32 from the position shown in FIG. 7 to the position shown in FIG. 8, a pressure signal as described above with respect to valve 12 is sent through the valve 212 from a surface location and read by pressure transducer 90 within the electronic trigger system 182. Hydraulic tubing 218 may be used to direct pressure from a pressure reading location within the flowbore 144 to the pressure transducer 90.

Figure 14:
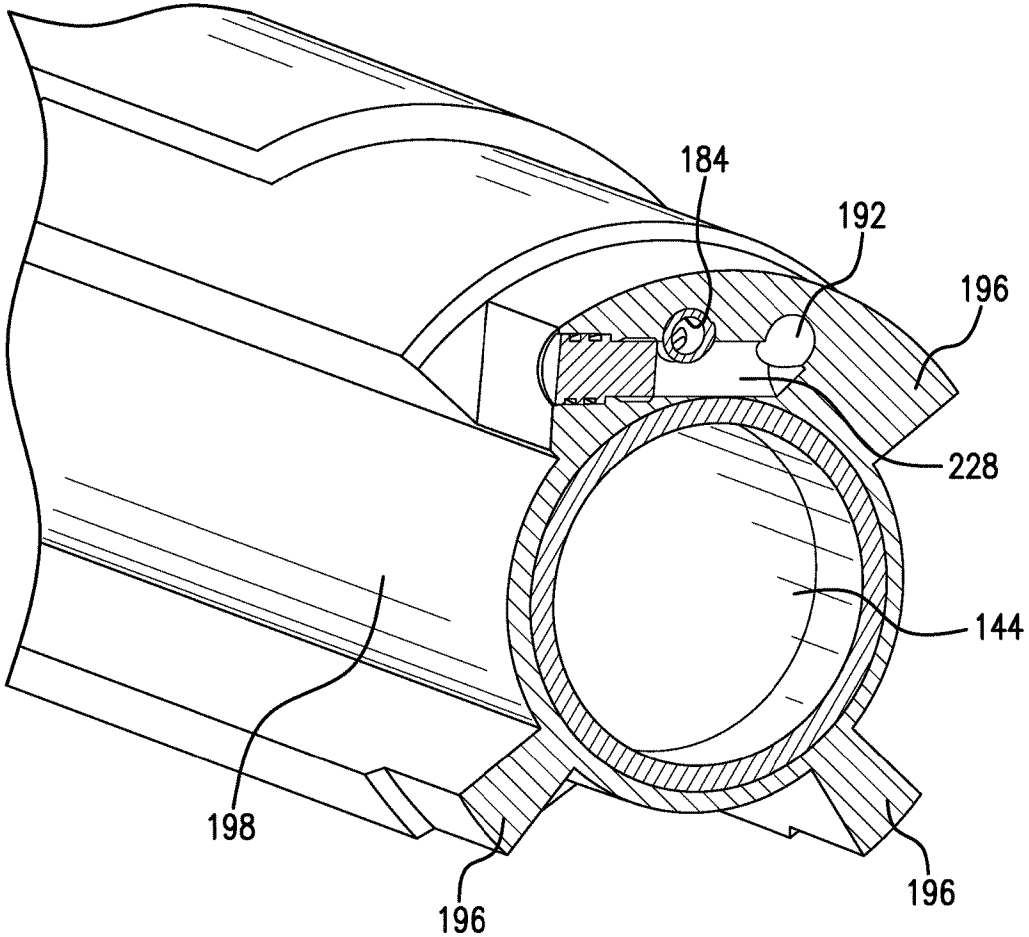
FIG. 14 shows a perspective and cross-sectional view of a sub within the valve of FIG. 7.
Figure 15:
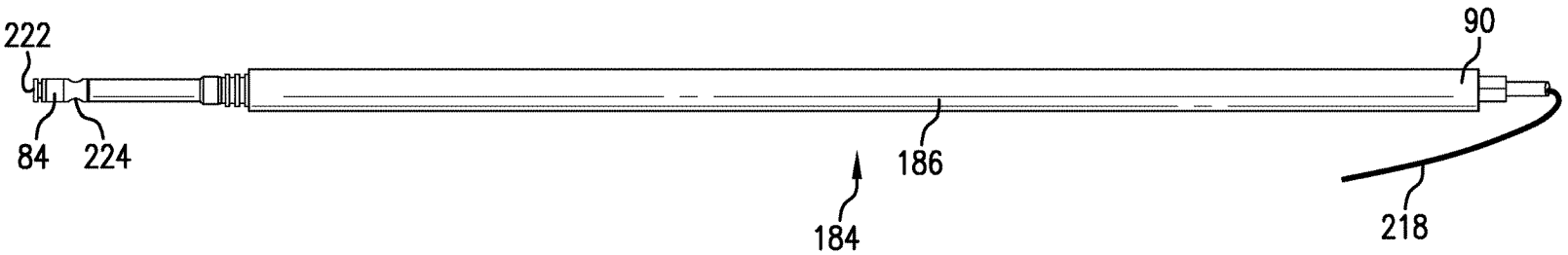
FIG. 15 shows a side view of an embodiment of an electronic trigger system module for the valve of FIG. 7.
Figure 16:
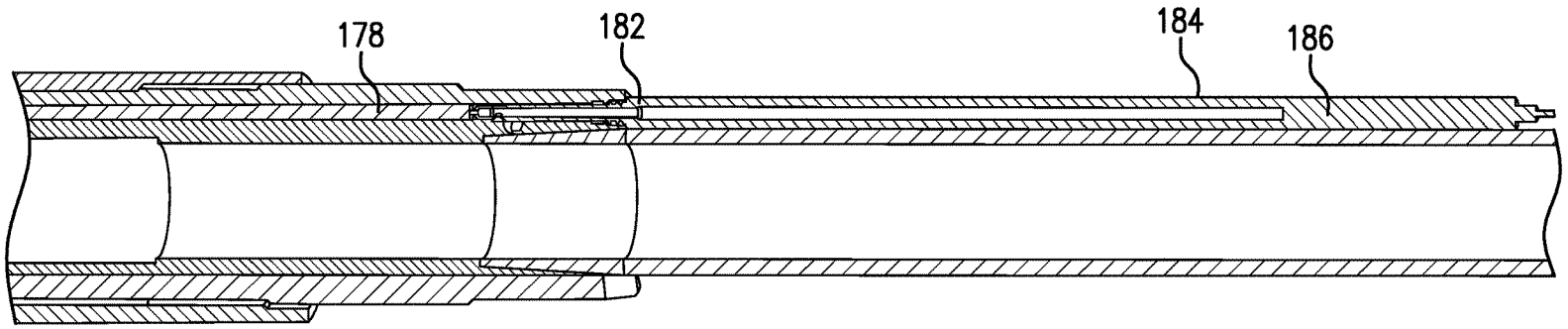
FIG. 16 shows a sectional view of a portion of the valve of FIG. 7.
Figure 17:
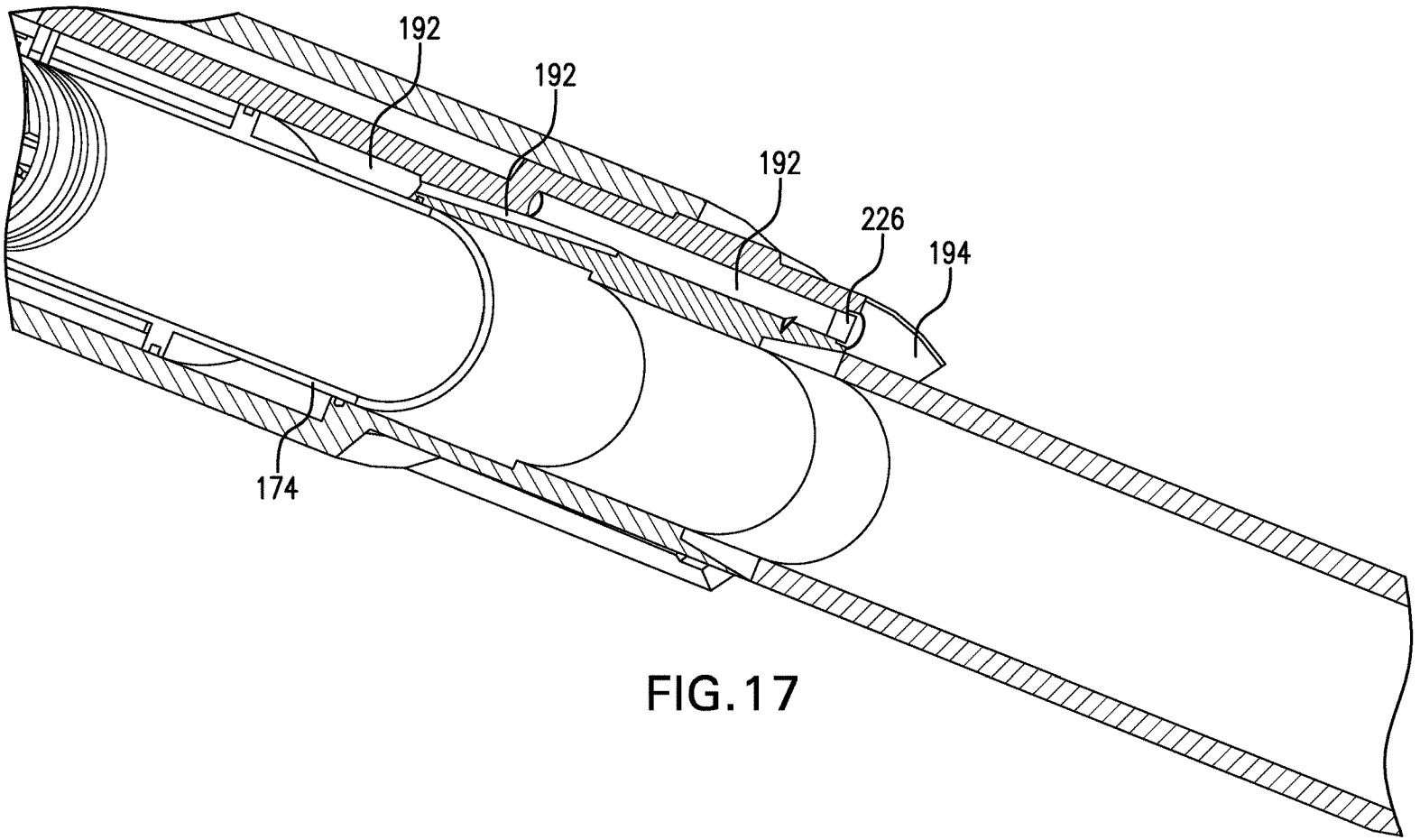
FIG. 17 shows perspective and sectional view of a portion of the valve of FIG. 7.

The second piston 174 and the locking mechanism 200 are positioned within sub 194. As shown in FIGS. 9 and 14, the sub 194 includes a longitudinal portion having a plurality of lobes 196 separated by longitudinally extending channels 198. One of the lobes 196 may be larger than the others for accommodating portions of the electronic trigger system 182. With reference to FIG. 15, the electronic trigger system module 184 includes housing 186 forming a pressure vessel to accommodate at least one battery 88 and other electronics such as the controller 86 and associated connections inside. At a first end, corresponding to an uphole end, the module 184 includes two adjacent ports, an air chamber port 222 and a hydraulic fluid chamber port 224. The electronic trigger 84 is positioned between the port 222 to the air chamber 178 (FIG. 16) and the port 224 to the hydraulic fluid chamber 192. The pressure transducer 90 is provided at a second end, longitudinally opposite the first end, of the module 184. The hydraulic tubing 218 extends from the pressure transducer 90 in the electronic trigger system module 184 to a location where a pressure reading is to be taken, such as, but not limited to the flowbore 144. Once the pressure signal chosen to open the valve 212 is read by the pressure transducer 90, the electronic trigger 84 fluidically communicates the hydraulic fluid chamber 192 to the air chamber 178. FIG. 16 shows the electronic trigger module 184 secured, such as screwed in, to the sub 194 and the port 222 to the air chamber 178 is communicable with the air chamber 178 which may be in line with the electronic trigger module 184 and bored into the lobe 196 of the sub 194. FIG. 17 depicts the hydraulic fluid chamber 192, which extends from the lobe 196 towards the second end of the second piston 174. The hydraulic fluid chamber 192 fluidically communicates with the port 224 of the module 184. A plug 226 may be used to maintain the hydraulic fluid 80 in the hydraulic fluid chamber 192. FIG. 14 shows a path 228 that communicates the electronic trigger module 184 to the hydraulic fluid chamber 192. Thus, when the electronic trigger 84 is activated, the port 224 to the hydraulic fluid chamber 192 is in communication with the port 222 to the air chamber 178, and since the hydraulic fluid pressure is higher than the air chamber pressure, the hydraulic fluid 80 is moved from the chamber 192 near the piston 174, and forces the piston 174 in the downhole direction 32 by hydrostatic pressure to also move the first piston 172 to the second position of the first piston 172, corresponding to the open condition of the valve 212. Although the air chamber 178 is separated from the hydraulic fluid chamber 192 by the electronic trigger 84, in the event of a leak, the valve 212 will move to the open condition. That is, the valve 212 is designed such that is cannot remain stuck in the closed position, as it is openable upon failure.

After the valve 212 has been activated to open electronically, the valve 212 can subsequently be closed and reopened as many times as necessary mechanically. To close the valve 212, a shifting tool can be run through the main flowbore 144 to grab a profile 158 of the profile sleeve 208 at the inner surface of the ring 210 and shift the profile sleeve 208 in the uphole direction 34. Because the profile sleeve 208 is trapped within the locking sleeve 204, which is attached to the piston 172, the valve 212 is transferred to the closed condition by moving the piston 172 to the first position shown in FIG. 7 (except the second piston 174 will remain in the electronically activated position shown in FIG. 8). The locking sleeve includes a set of deflectable fingers 206 that are either supported or not supported by the ring 210 of the profile sleeve 208. When supported, the deflectable fingers 206 cannot be deflected radially inward, but when not supported, the deflectable fingers 206 can be deflected radially inward. Thus, when not supported, the locking sleeve 204 and thus the attached piston 172 can move relative to the sub 194. Because the profile sleeve 208 is trapped within the locking sleeve 204, movement of the profile sleeve 208 can move the locking sleeve 204 and thus the piston 172 mechanically and the deflectable fingers 206 can lock into an inner profile 228 within the sub 194 surrounding the locking sleeve 204. The deflectable fingers 206 deflect inward while traveling through the sub 194 until the fingers 206 snap into the groove of the inner profile 228. When the ring 210 of the profile sleeve 208 is aligned with the heads of the fingers 212, the fingers 212 are prevented from moving out of the inner profile 228, and the locking mechanism 200, and thus the piston 172, are locked in place until the profile sleeve 208 is moved. Thus, the piston 172 is movable back to the first position mechanically, and retained thereat by the locking mechanism 200, and the valve 112 is reclosed.

Figure 11:
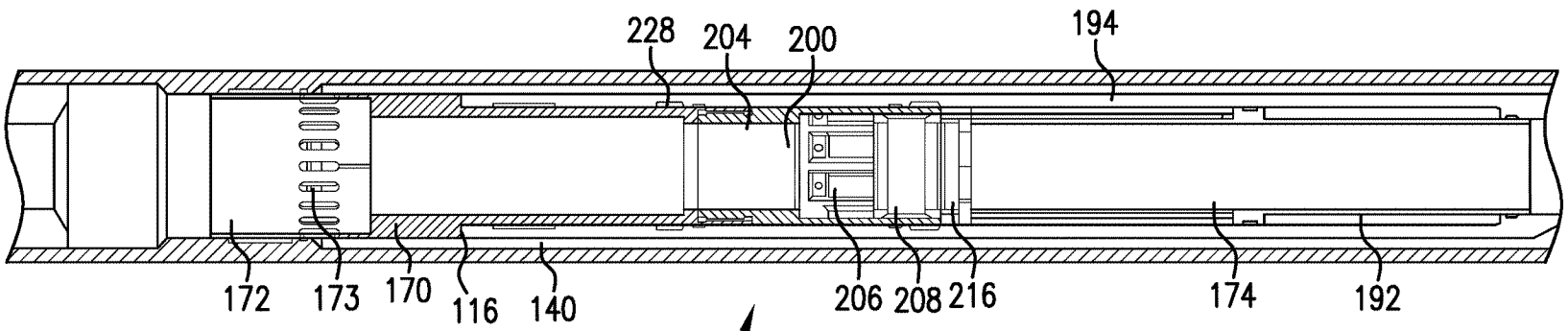
FIG. 11 shows a sectional view of the valve of FIG. 7 in a mechanically opened condition of the valve.
Figure 12:
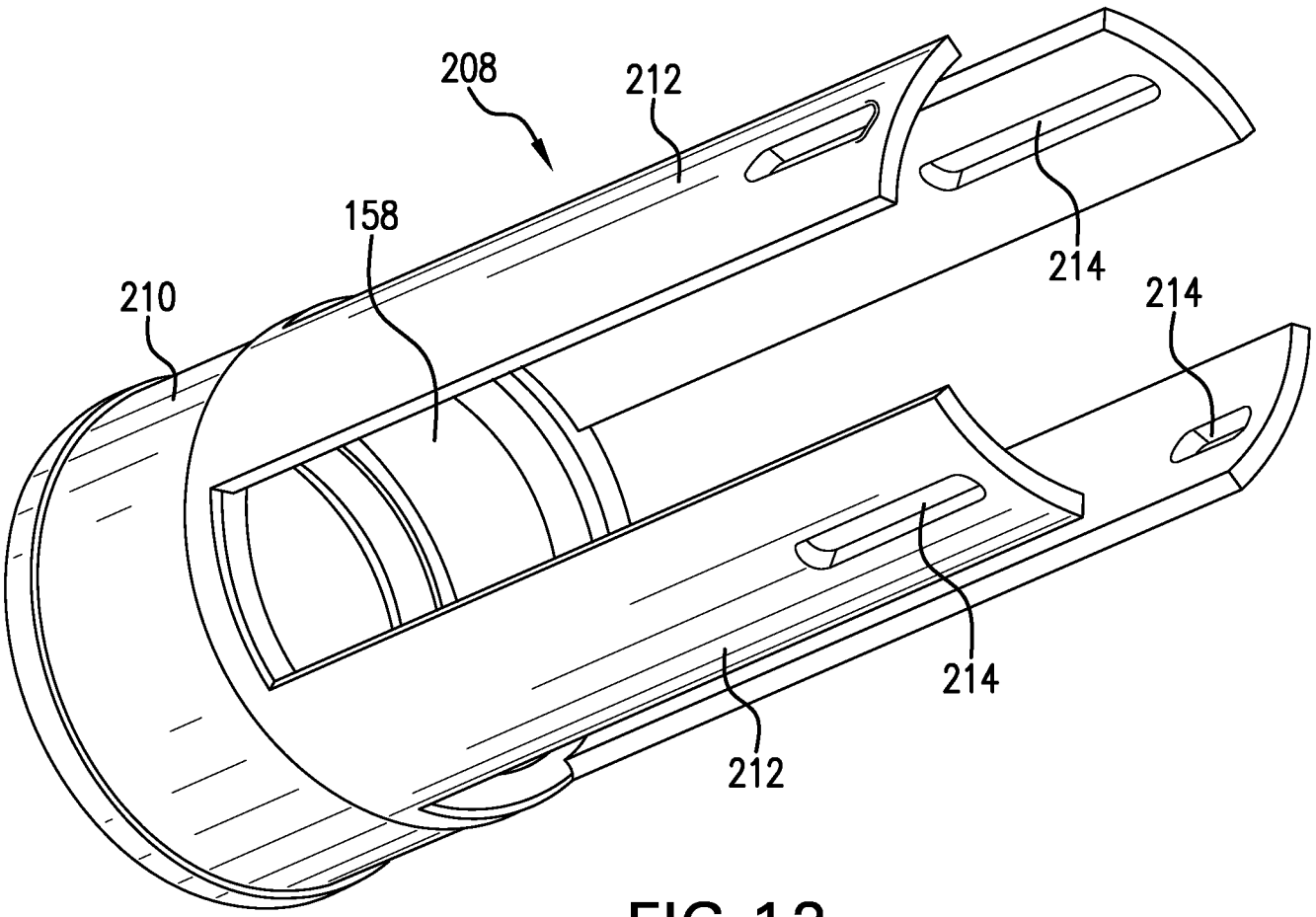
FIG. 12 shows a perspective view of an embodiment of a profile sleeve for the valve of FIG. 7.

As best shown in FIG. 13, a plurality of finger passages 230 are provided longitudinally through the wall 216 at the end of the locking sleeve 204 for passing the fingers 212 of the profile sleeve 208 therethrough, while the ring 210 is positioned within the locking sleeve 204 and prevented from exiting the locking sleeve 204 by the portions of the wall 216 positioned between the finger passages 230. In a case where the piston 174 cannot be electronically activated, such as if the electronic trigger 84 fails to operate, then the profile sleeve 208 is designed to allow for mechanical actuation of the valve 212 using a shifting tool, rather than expensive coiled tubing, due to a reduced force required to shear all of the pins 166. In such an embodiment, the piston 174 has not moved in the downhole direction 32 by electronic activation, and the fingers are attached to the piston 174 by the shear pins 166. Because the slots 214 in the fingers 212 have different lengths to provide a staggered shearing mechanism, the shear pins 166 will shear separately, one at a time, when the shifting tool pushes the profile sleeve 208 in the downhole direction 32 towards the piston 174, thus reducing the amount of force required as compared to shearing all the pins 166 simultaneously. Thus, the valve 212 can be opened mechanically with substantially reduced force if the valve 212 has not been opened by electronic activation. FIG. 11, for example, shows a condition where the valve 212 is opened mechanically (flow ports 173 are aligned with the downhole section of the annulus 140) and the piston 174 has not been electronically activated. Once the pins 166 have been sheared, the valve 212 can still be reclosed and reopened mechanically using the shifting tool since the locking mechanism 200 provides a system to lock the piston arrangement 170 in place, as described above.

Figure 18:
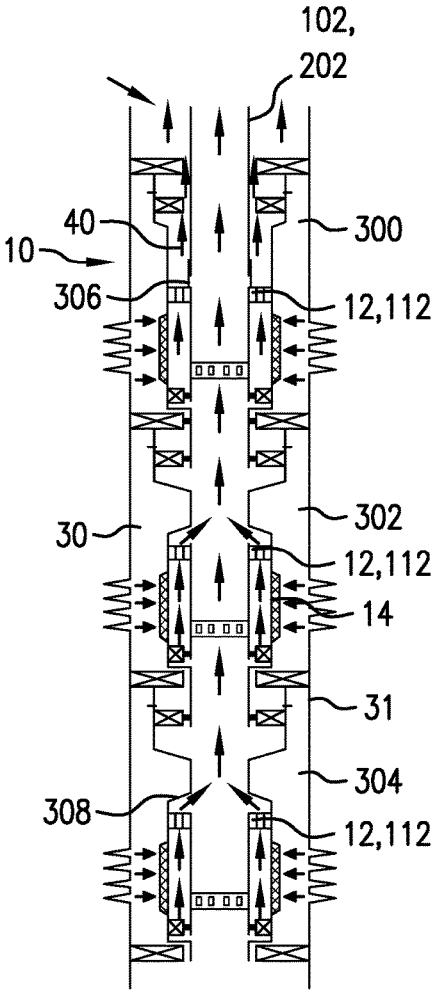
FIG. 18 shows a schematic view of an embodiment of the downhole system including the valves of FIG. 2 or 7 across multiple zones.
Figure 19:
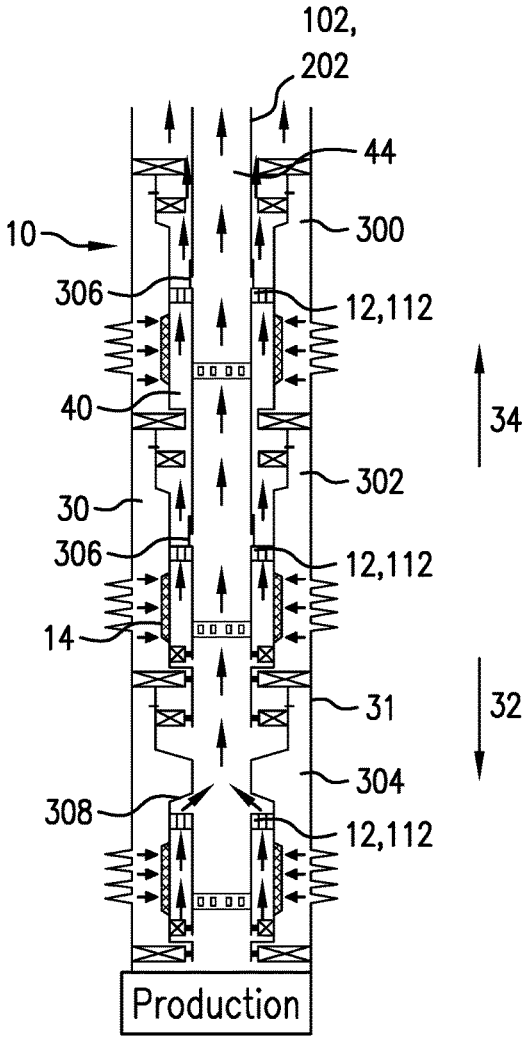
FIG. 19 shows a schematic view of another embodiment of the downhole system including the valves of FIG. 2 or 7 across multiple zones.

With reference now to FIGS. 18-19, different applications of a downhole system 10 using multiple isolation valves, either valve 12, 112, or a combination of valves 12, 112 are shown. The valves 12, 112 can be used in both upper, intermediate, and lower zones 300, 302, 304. While only three zones are illustrated, there may be one or more upper zones 300, one or more intermediate zones 302, and one or more lower zones 304. On upper zones 300, the valve 12, 112 may have a tieback receptacle 306 to receive tubing 102, 202 to maintain annular flow in the annulus 40 and thus separate production from the main flowbore 44. On lower zones 306, the valve 12, 112 may have a profile sub 308 connected uphole of the valve 12, 112 to prevent debris from falling into the valve 12, 112. FIG. 18 shows the upper zone maintaining annular flow in the annulus 40, and commingled intermediate and lower zones 302, 304. Inventory and cost are reduced in such a scenario because the same type of valve 12. 112 can be used for all three zones 300, 302, 304. The zones 300, 302, 304 are openable within tight pressure requirements, and are insensitive to brief pressure spikes, due to the electronic trigger system 82, 182. Two different production streams (through the annulus 40 and through the flowbore 44) are producible from identical valves 12, 112. FIG. 19 shows production from the lower zone 304 separated from production from the commingled upper and intermediate zones 300, 302. The upper and intermediate zone valves 12, 112 have tieback receptacles 306 instead of profile subs 308. The upper zone annulus 40 ties into the middle zone tieback receptacle 306. The tubing 202 ties back into the upper zone tieback receptacle 306. While two scenarios have been disclosed in FIGS. 18 and 19, it should be understood that these are non-limiting examples and the valve 12, 112 can be used in any number of zones and alternate configurations.

The electronic trigger activation ensures that the valve 12, 112 will not open inadvertently due to pressure spikes. Because of the electrical nature of the electronic trigger 84, the valves 12, 112 may be programmed to open in a specific timed sequence for flow testing. The electronic trigger design also allows the valve 12, 112 to be used on upper zones 300 and lower zones 304, whereas without the electronic trigger design a different type of valve would be required for lower zones. The valves 12, 112 are capable of being used for both flow up an annulus 40 and flow into the flowbore 44.

Dual piston flow geometry does not block production fluids within the main flowbore 44, 144, which also allows redundant opening mechanisms to be included. Also, the valve 12, 112 includes mechanically advantaged shifting profile which allows the mechanical contingency opening method to work using less expensive slick line equipment, rather than extremely expensive coil tubing, which can cost about 4 to 10 million dollars on a deepwater rig. By employing a staggered shearing mechanism, through use of shear links 60 or slots 214 of differing lengths, the necessity of shearing a large number of shear pins simultaneously is eliminated, and coil tubing is not required to provide the large amount of force otherwise necessary. In the embodiments described, shear pins 66, 166 are not sheared all at the same time, and therefore this limits the force required to actuate the valve 12, 112 mechanically.

Embodiment 1

A downhole system including a valve including a housing having a longitudinal axis, a flowbore within the housing for fluid flow along the longitudinal axis, an annulus within the housing, the annulus concentrically surrounding the flowbore and fluidically separated from the flowbore, a piston arrangement within the housing, the piston arrangement including a piston movable from a first position to a second position, and an electronic trigger system including an electronic trigger, a first fluid chamber, and a second fluid chamber. Activation of the electronic trigger communicates the first fluid chamber with the second fluid chamber to move the piston from the first position corresponding to a closed condition of the valve blocking flow within the annulus to the second position corresponding to an open condition of the valve permitting flow within the annulus past the piston.

Embodiment 2

The downhole system of embodiment 1, wherein the valve further includes an inner profile accessible from the flowbore, the valve mechanically movable from the closed condition to the open condition by engaging and moving the inner profile.

Embodiment 3

The downhole system of embodiment 2, wherein the piston is a first piston, and the valve further includes a second piston, the second piston supporting the inner profile, the second piston shiftable from a first position corresponding to the closed condition of the valve to a second position corresponding to the open condition of the valve using the inner profile.

Embodiment 4

The downhole system of embodiment e, wherein the first and second pistons at least partially overlap in the closed condition of the valve and are separated in the open condition of the valve.

Embodiment 5

The downhole system of embodiment 2, wherein the valve is mechanically reclosable from the open position to the closed position by engaging and moving the profile.

Embodiment 6

The downhole system of embodiment 5, wherein the valve further includes a locking mechanism and a profile member having the profile movable within the locking mechanism, the locking mechanism movable within the housing to lock the valve in the closed condition.

Embodiment 7

The downhole system of embodiment 2, wherein the valve includes a plurality of shear pins securing the valve in the closed condition, and a staggered shearing arrangement operatively arranged to shear the shear pins in a non-simultaneous manner during movement of the valve from the closed condition to the open condition.

Embodiment 8

The downhole system of embodiment 7, wherein the staggered shearing arrangement includes a plurality of shear links attached to the shear pins, at least two of the shear links having different lengths from each other, the shear links non-simultaneously engaged to shear the shear pins during movement of the valve from the closed condition to the open condition by engagement with the inner profile.

Embodiment 9

The downhole system of embodiment 7, wherein the staggered shearing arrangement includes a plurality of longitudinally extending fingers with a slot on each finger, at least two of the slots having different lengths from each other, the shear pins passing through the slots, respectively, and ends of the slots are non-simultaneously engaged with the shear pins, respectively, during movement of the valve from the closed condition to the open condition by engagement with the inner profile.

Embodiment 10

The downhole system of embodiment 1, wherein the electronic trigger system further includes a pressure transducer, and a pressure signal delivered through the flowbore and sensed by the pressure transducer activates the electronic trigger.

Embodiment 11

The downhole system of embodiment 1, wherein the electronic trigger system includes a pressure vessel housing a battery, microprocessor, and the electronic trigger, and the pressure vessel is a modular element securable within the housing of the downhole system.

Embodiment 12

The downhole system of embodiment 1, further comprising a tubular sub within the housing, the tubular sub having a plurality of radially projecting lobes separated by longitudinally extending channels in the annulus, the electronic trigger housed in a first lobe amongst the plurality of lobes.

Embodiment 13

The downhole system of embodiment 12, wherein the first fluid chamber is an air chamber disposed within the first lobe.

Embodiment 14

The downhole system of embodiment 1, wherein the first fluid chamber is an air chamber and the second fluid chamber is a hydraulic fluid chamber, and activation of the electronic trigger permits hydraulic fluid from the hydraulic fluid chamber to enter the air chamber.

Embodiment 15

The downhole system of embodiment 1, further comprising a screen assembly attached to the housing, the screen assembly permitting fluid to enter the annulus and flow towards the valve.

Embodiment 16

The downhole system of embodiment 1, further comprising a tubing selectively connected uphole of the valve to provide annular flow uphole of the valve, wherein, when the tubing is not connected to the valve, flow from the annulus is commingled with flow along the longitudinal axis uphole of the valve.

Embodiment 17

A method of permitting flow in an annulus of a valve includes arranging a piston in a first position corresponding to a closed position of the valve to block continued annular flow within the valve; activating an electronic trigger with a communication signal; and moving the piston to a second position corresponding to an open position of the valve to permit continued annular flow within the valve.

Embodiment 18

The method of embodiment 17, further comprising mechanically reclosing the piston to block annular flow within the valve.

Embodiment 19

The method of embodiment 17, further comprising moving the piston mechanically if the electronic trigger fails or if the electronic trigger has already been activated.

Embodiment 20

The method of embodiment 19, wherein the valve is shear pinned in a closed condition during run-in of the valve, and moving the piston includes moving the piston mechanically to shear a plurality of shear pins in a non-simultaneous manner using a staggered shearing mechanism.

Embodiment 21

The method of embodiment 17, further comprising selectively attaching a tubing uphole of the valve, wherein the tubing provides annular flow uphole of the valve when attached, and, when the tubing is not attached, flow from the annulus uphole of the valve commingles with flow along the longitudinal axis.

Embodiment 22

The method of embodiment 17, wherein activating the electronic trigger with a communication signal includes sending a pressure signal down a flowbore of the valve and detecting the pressure signal with a pressure transducer.

Embodiment 23

The method of embodiment 17, wherein activating the electronic trigger includes receiving the communication signal with a signal-receiving member and delaying activation of the electronic trigger for a preset time period as determined by a controller.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole system comprising a valve including:

a housing having a longitudinal axis;

a flowbore within the housing for fluid flow along the longitudinal axis;

an annulus within the housing, the annulus concentrically surrounding the flowbore and fluidically separated from the flowbore;

a piston arrangement within the housing, the piston arrangement including a first piston and a second piston, the first piston movable from a first position to a second position; and, an electronic trigger system including an electronic trigger, a first fluid chamber, and a second fluid chamber;

wherein activation of the electronic trigger communicates the first fluid chamber with the second fluid chamber to move the first piston from the first position corresponding to a closed condition of the valve blocking flow within the annulus to the second position corresponding to an open condition of the valve permitting fluid to flow along a length of and past the piston within the annulus, the valve further including an inner profile accessible from the flowbore, the valve mechanically movable from the closed condition to the open condition by engaging and moving the inner profile which moves one of the first and second pistons of the piston arrangement.

2. The downhole system of claim 1, wherein the valve is mechanically reclosable from the open position to the closed position by engaging and moving the profile.

3. The downhole system of claim 2, wherein the valve further includes a locking mechanism and a profile member having the profile movable within the locking mechanism, the locking mechanism movable within the housing to lock the valve in the closed condition.

4. The downhole system of claim 1, wherein the electronic trigger system further includes a pressure transducer, and a pressure signal delivered through the flowbore and sensed by the pressure transducer activates the electronic trigger.

5. The downhole system of claim 1, wherein the electronic trigger system includes a pressure vessel housing a battery, microprocessor, and the electronic trigger, and the pressure vessel is a modular element securable within the housing of the downhole system.

6. The downhole system of claim 1, wherein the first fluid chamber is an air chamber and the second fluid chamber is a hydraulic fluid chamber, and activation of the electronic trigger permits hydraulic fluid from the hydraulic fluid chamber to enter the air chamber.

7. The downhole system of claim 1, further comprising a screen assembly attached to the housing, the screen assembly permitting fluid to enter the annulus and flow towards the valve.

8. The downhole system of claim 1, further comprising a tubing selectively connected uphole of the valve to provide annular flow uphole of the valve, wherein, when the tubing is not connected to the valve, flow from the annulus is commingled with flow along the longitudinal axis uphole of the valve.

9. A method of permitting flow in the annulus of the valve of the downhole system of claim 1, the method comprising:

arranging the piston in the first position;

activating the electronic trigger with a communication signal; and, moving the piston to the second position.

10. The method of claim 9, further comprising mechanically reclosing the piston to block annular flow within the valve.

11. The method of claim 9, further comprising moving the piston mechanically if the electronic trigger fails or if the electronic trigger has already been activated.

12. The method of claim 11, wherein the valve is shear pinned in the closed condition during run-in of the valve, and moving the piston includes moving the piston mechanically to shear a plurality of shear pins in a non-simultaneous manner using a staggered shearing mechanism.

13. The method of claim 9, further comprising selectively attaching a tubing uphole of the valve, wherein the tubing provides annular flow uphole of the valve when attached, and, when the tubing is not attached, flow from the annulus uphole of the valve commingles with flow along the longitudinal axis.

14. The method of claim 9, wherein activating the electronic trigger with the communication signal includes sending a pressure signal down the flowbore of the valve and detecting the pressure signal with a pressure transducer.

15. The method of claim 9, wherein activating the electronic trigger includes receiving the communication signal with a signal-receiving member and delaying activation of the electronic trigger for a preset time period as determined by a controller.

16. A downhole system comprising a valve including:

a housing having a longitudinal axis;

a flowbore within the housing for fluid flow along the longitudinal axis;

an annulus within the housing, the annulus concentrically surrounding the flowbore and fluidically separated from the flowbore;

a piston arrangement within the housing, the piston arrangement including a piston movable from a first position to a second position; and, an electronic trigger system including an electronic trigger, a first fluid chamber, and a second fluid chamber;

wherein activation of the electronic trigger communicates the first fluid chamber with the second fluid chamber to move the piston from the first position corresponding to a closed condition of the valve blocking flow within the annulus to the second position corresponding to an open condition of the valve permitting flow within the annulus past the piston, and the valve further includes an inner profile accessible from the flowbore, the valve mechanically movable from the closed condition to the open condition by engaging and moving the inner profile, and the piston is a first piston, and the valve further includes a second piston, the second piston supporting the inner profile, the second piston shiftable from a first position corresponding to the closed condition of the valve to a second position corresponding to the open condition of the valve using the inner profile.

17. The downhole system of claim 16, wherein the first and second pistons at least partially overlap in the closed condition of the valve and are separated in the open condition of the valve.

18. A downhole system comprising a valve including:

a housing having a longitudinal axis;

a flowbore within the housing for fluid flow along the longitudinal axis;

an annulus within the housing, the annulus concentrically surrounding the flowbore and fluidically separated from the flowbore;

a piston arrangement within the housing, the piston arrangement including a piston movable from a first position to a second position; and, an electronic trigger system including an electronic trigger, a first fluid chamber, and a second fluid chamber;

wherein activation of the electronic trigger communicates the first fluid chamber with the second fluid chamber to move the piston from the first position corresponding to a closed condition of the valve blocking flow within the annulus to the second position corresponding to an open condition of the valve permitting flow within the annulus past the piston, and the valve further includes an inner profile accessible from the flowbore, the valve mechanically movable from the closed condition to the open condition by engaging and moving the inner profile, and the valve includes a plurality of shear pins securing the valve in the closed condition, and a staggered shearing arrangement operatively arranged to shear the shear pins in a non-simultaneous manner during movement of the valve from the closed condition to the open condition.

19. The downhole system of claim 18, wherein the staggered shearing arrangement includes a plurality of shear links attached to the shear pins, at least two of the shear links having different lengths from each other, the shear links non-simultaneously engaged to shear the shear pins during movement of the valve from the closed condition to the open condition by engagement with the inner profile.

20. The downhole system of claim 18, wherein the staggered shearing arrangement includes a plurality of longitudinally extending fingers with a slot on each finger, at least two of the slots having different lengths from each other, the shear pins passing through the slots, respectively, and ends of the slots are non-simultaneously engaged with the shear pins, respectively, during movement of the valve from the closed condition to the open condition by engagement with the inner profile.

21. A downhole system comprising a valve including:

a housing having a longitudinal axis;

a flowbore within the housing for fluid flow along the longitudinal axis;

an annulus within the housing, the annulus concentrically surrounding the flowbore and fluidically separated from the flowbore;

a piston arrangement within the housing, the piston arrangement including a piston movable from a first position to a second position;

an electronic trigger system including an electronic trigger, a first fluid chamber, and a second fluid chamber; and a tubular sub within the housing, the tubular sub having a plurality of radially projecting lobes separated by longitudinally extending channels in the annulus, the electronic trigger housed in a first lobe amongst the plurality of lobes;

wherein activation of the electronic trigger communicates the first fluid chamber with the second fluid chamber to move the piston from the first position corresponding to a closed condition of the valve blocking flow within the annulus to the second position corresponding to an open condition of the valve permitting flow within the annulus past the piston.

22. The downhole system of claim 21, wherein the first fluid chamber is an air chamber disposed within the first lobe.

23. The downhole system of claim 21, wherein the valve further includes an inner profile accessible from the flowbore, the valve mechanically movable from the closed condition to the open condition by engaging and moving the inner profile.

* * * * *